United States Patent [19]

Nichols, Jr.

[11] Patent Number: 4,601,727

[45] Date of Patent: Jul. 22, 1986

[54] TEXTILE DYEING PROCESS AND APPARATUS FOR MULTICOLOR PATTERNS

[75] Inventor: David B. Nichols, Jr., Dalton, Ga.

[73] Assignee: RCA Corporation, Princeton, N.J.

[21] Appl. No.: 639,843

[22] Filed: Aug. 13, 1984

[51] Int. Cl.[4] ..... D06P 5/00

[52] U.S. Cl. ..... 8/477; 8/478; 8/485; 8/151; 8/158; 8/929; 68/13 R

[58] Field of Search ..... 8/478, 485, 477

[56] References Cited

U.S. PATENT DOCUMENTS

| | | | |
|---|---|---|---|
| 3,393,411 | 7/1968 | McElveen | 8/151 |
| 3,683,649 | 8/1972 | Takriti et al. | 68/5 D |
| 3,726,640 | 4/1973 | Takriti et al. | 8/483 |
| 3,731,503 | 5/1973 | Appenzeller et al. | 68/205 R |
| 3,800,568 | 4/1974 | Takriti et al. | 68/205 R |
| 3,964,860 | 6/1976 | Leifeld et al. | 8/151 |
| 4,010,709 | 3/1977 | Sayman et al. | 118/33 |
| 4,127,014 | 11/1978 | Miller et al. | 68/13 R |
| 4,146,362 | 3/1979 | Nichols | 8/485 |
| 4,189,302 | 2/1980 | Toland | 8/485 |
| 4,329,143 | 5/1982 | Hutcheson | 8/483 |
| 4,403,360 | 9/1983 | Finney et al. | 8/151 |

FOREIGN PATENT DOCUMENTS

| | | |
|---|---|---|
| 1106107 | 8/1981 | Canada . |
| 1128710 | 8/1982 | Canada . |
| 1128708 | 8/1982 | Canada . |
| 1128709 | 8/1982 | Canada . |
| 1128711 | 8/1982 | Canada . |
| 1138156 | 12/1982 | Canada . |
| 1243403 | 8/1971 | United Kingdom . |

OTHER PUBLICATIONS

K. Zimmerli, American Dyestuff Reporter, 1978 (Jun.), pp. 19–26.

"Continuous Dyeing of Solid Shades and Random Patterns on Carpets," by Kurt Zimmerli, *American Dyestuff Reporter,* Jun. 1978, pp. 19–23, 26.

Leaflet of the Firm Kusters, entitled "TAK-Patterning for Textiles and Coatings".

"New Multicolor Dyeing Method for Carpets," by Ferdinand Leifeld, *American Dyestuff Reporter,* Jun. 1971, pp. 25–31.

"Multiple Coloration of Carpets in Piece Form," by T. L. Dawson, *J. Society of Dyers and Colourists,* Jul. 1974, pp. 235–238.

*Primary Examiner*—A. Lionel Clingman

*Attorney, Agent, or Firm*—Joseph S. Tripoli; George E. Haas; William Squire

[57] ABSTRACT

Two linear arrays of foamed dyestuff dispensing nozzles reciprocate 180° out of phase normal to the path of a carpet web being dyed. Each array dispenses streams of foamed dyestuff over a gum coated web in alternate groups of first and second colors, the second array dispensing its dyestuff superimposed over the dyestuff dispensed by the first array. The same dyestuff color groups overlap in spaced repeating regions of the carpet web while different colors overlap in the remaining regions to provide a fully dyed web having the appearance of repetitive spaced regions of either the first or the second colors.

9 Claims, 10 Drawing Figures

TEXTILE DYEING PROCESS AND APPARATUS FOR MULTICOLOR PATTERNS

The present invention relates to a continuous process for dyeing textiles which is particularly suitable for tufted carpeting.

One continuous process is known as "TAK" dyeing, in which dye is deposited, in drops or streams, on the tufted side of the carpet. The terms "dye," "dye liquor," "dye solution," and "dyestuff" are used interchangeably hereinafter and include a dye color mixed with a carrier in a form suitable for application to a textile. A wide variety of dye colors may be employed and many different random color patterns obtained in the TAK processes. Typical apparatuses which may be used for applying the dyes in streams and as drops are disclosed, for example, in U.S. Pat. Nos. 3,683,649; 3,726,640; 3,731,503; 3,800,568; 3,964,860; 4,010,709; and 4,189,302.

The latter two patents also illustrate particular forms of a process known as gum-TAK. In my application Ser. No. 661,396, filed Feb. 25, 1976, now abandoned, and having corresponding British Pat. No. 1,578,039 and Canadian Pat. No. 1,106,107, among others, I describe a method and apparatus, now in wide use, for producing one group of styles employing a gum-TAK process. In this method, a layer of liquid, such as a water-soluble gum, is applied to the tufted surface of the carpeting and then drops of dye(s) are applied to the gum-wetted tufts. The process produces randomly varying patterns with gentle shading effects.

In another process described in my U.S. Pat. No. 4,146,362 I describe a relatively viscous first dye that is deposited, for example, in drops onto spaced regions of a textile and a less viscous second dye is then deposited onto regions of the textile which include the spaced regions.

Other textile dyeing processes are disclosed and described in my copending application Ser. Nos. 916,889; 916,893; 916,900; 916,901; and 916,903 all filed on June 19, 1978, each entitled "Textile Dyeing Process" and assigned to the assignee of the present invention. These applications have corresponding foreign patents including respective Canadian Pat. Nos. 1,128,709; 1,128,711; 1,128,710; 1,138,156; and 1,128,708.

In my copending application Ser. No. 916,900, I describe in FIG. 4 a pattern of dropped dyestuff in two different colors produced by a multi-TAK machine. This TAK apparatus deposits drops or streams of dyes of one or more colors in repeating continuous or discontinuous spaced patterns on the carpet, in zigzag patterns or combinations of different patterns. The multi-TAK machine and related processes are described in an article entitled "Continuous Dyeing of Solid Shades and Random Patterns on Carpets," by Kurt Zimmerli, *American Dyestuff Reporter*, June 1978. The above-described processes use various forms of the gum-TAK process, describe numerous patterning effects that have now been in wide use for a number of years, and have been successful in meeting the needs for new styles which are both pleasing and attractive.

In the described processes, the carpet is prewetted prior to the application of the water soluble gum layer. The dyes that are dropped onto the carpet surface generally have a low liquid viscosity, for example, about 200 CPS or lower. While those processes have the advantage in that they are continuous, they have the disadvantage in that they use relatively large amounts of liquid. For example, as I describe in my copending application Ser. No. 916,900, the disclosed process utilizes about 130–140 percent prewet liquid pickup, where the percent pickup is a measure of the weight of the liquid in a given area of the carpet to the weight of the dry carpet for that area, multiplied by 100. The total percent liquid pickup including the prewet liquids, the gum layer and dyes may be in the range of 400 to 500 percent. The large amounts of liquids used in these processes tend to require excessive energy consumption and result in significant material waste.

Foam dyeing has recently been successful in alleviating the high consumption of energy and reducing waste of the TAK dyeing processes. In the foam dyeing process liquid dyes are mixed with air to foam the dyestuff. The foamed dyestuff, which uses a significantly lower amount of liquid for a given dyed area as compared to TAK dyeing, is then applied to the tufted side of the carpet. This process also uses less prewet liquid to thereby reduce the total amount of liquid used. The viscous gum layer employed in prior processes may be employed in the foam dyeing process. However, even where gum is used, there is a significant drop in the water content of a given area of carpet which drop tends to reduce the consumption of energy and liquid waste. For example, in foam dyeing, the prewet liquids, the gum layer and the dyes result in about 220 percent pickup.

One foam dyeing apparatus that has achieved recent success is known as the Kusters foam dyeing applicator and is described in more detail hereinafter. This apparatus includes two linear arrays of closely spaced dyestuff foam dispensing nozzles extending across the carpet web width, each array being mounted for reciprocating transversely across the carpet width as the carpet web passes therebeneath. The nozzles each receive a foamed dyestuff of a given color and are connected to valves which can provide continuous or discontinuous flow of the foamed dyestuff therethrough.

In some cases, dyestuff of only one color is applied to all of the nozzles to provide a solid coloring effect. For multicolor effects, the nozzles may be supplied with a number of different complimentary or analogous color dyestuffs. The dyestuffs tend to mix and blend after being applied to the gum coated tufted carpet surface since the dyestuff tends to flow somewhat on top of the gum coated carpet web prior to the steaming step. The nozzle arrays when moved in unison tend to produce a zigzag color path. When moved out of phase, the paths tend to overlap and produce random blended, multicoloring effects.

While the solid color and multicolor effects are desirable and quite pleasing, I have realized that there is a need for providing a repeating pattern effect of spaced uniquely colored regions on tufted carpeting utilizing the foam process. In using the above described foam dyeing machine, I have observed that when multiple colored dyes are employed and the different nozzles are moved out of phase, the applied colors tend to blend, apparently because of the large number of nozzles and the general tendency of the dyes to flow together on the carpet surface prior to the steaming step. When one color is employed in adjacent nozzles it normally tends to produce either straight lines, zigzag patterns or the blending effect, as described, depending on the relative nozzle motions among other relationships.

I found that to produce a pattern effect in which there is a repetition of spaced regions of a given color with the multi-nozzle foam dyeing machine while at the same time having a fully colored carpet with no uncolored regions was relatively difficult. First attempts to achieve the desired spaced pattern effect included turning the nozzles of a given color on and off in given time periods. However, the carpet web was not fully dyed. Leaving the nozzles on in a continuous stream mode during the entire dyeing process to fully color the carpet web normally did not produce the repeating spaced pattern effect which I sought.

A continuous textile dyeing process according to the present invention comprises moving a length of a textile web in a forward direction and supplying dyestuffs in a sequence of alternate first and second colors to a first set of spaced nozzles and to a second set of spaced nozzles spaced from the first set. The first set and the second set of nozzles are moved back and forth across the width of the web in opposite directions. The nozzles apply the received dyestuffs to a surface of the forward moving textile with the dyestuff from one set superimposed over the dyestuff from the other set. The spacing of the nozzles and the distance the sets of nozzles move across the web are such that repeating spaced patterns of substantially only the first color and of substantially only the second color are produced on the textile surface having a background region containing the first and second colors, each pattern of a given color being produced by dyestuffs from both sets of nozzles.

Figures 1, 2, 3, 3A:
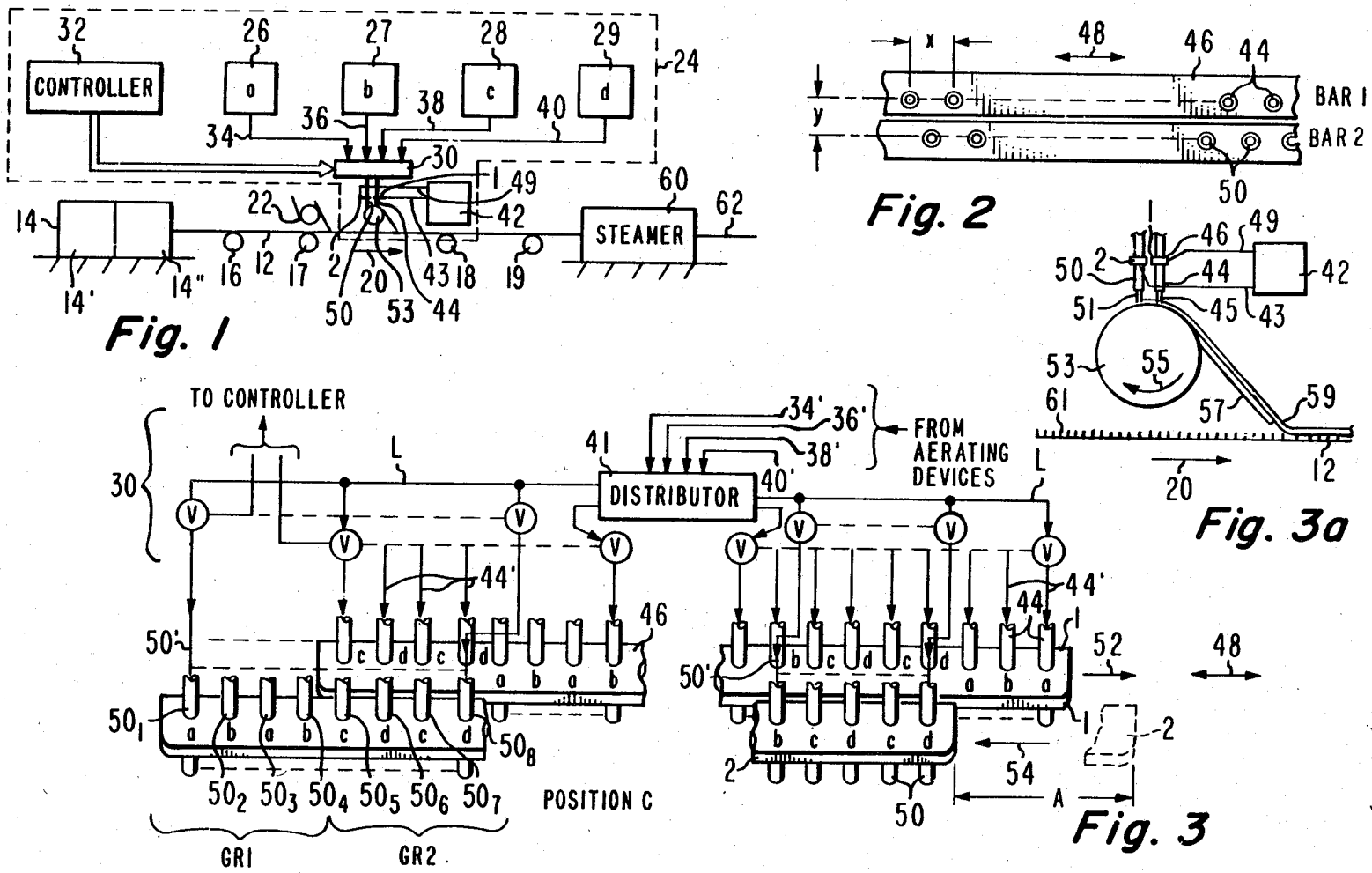
FIG. 1 is a schematic side elevation view of a carpet dyeing apparatus used to practice an embodiment of the present invention.
FIG. 2 is a plan view of a dyestuff dispensing nozzle portion of the apparatus of FIG. 1.
FIG. 3 is an isometric view of a portion of the apparatus of FIG. 1 illustrating another view of the dyestuff dispensing nozzles.
Figure 4:
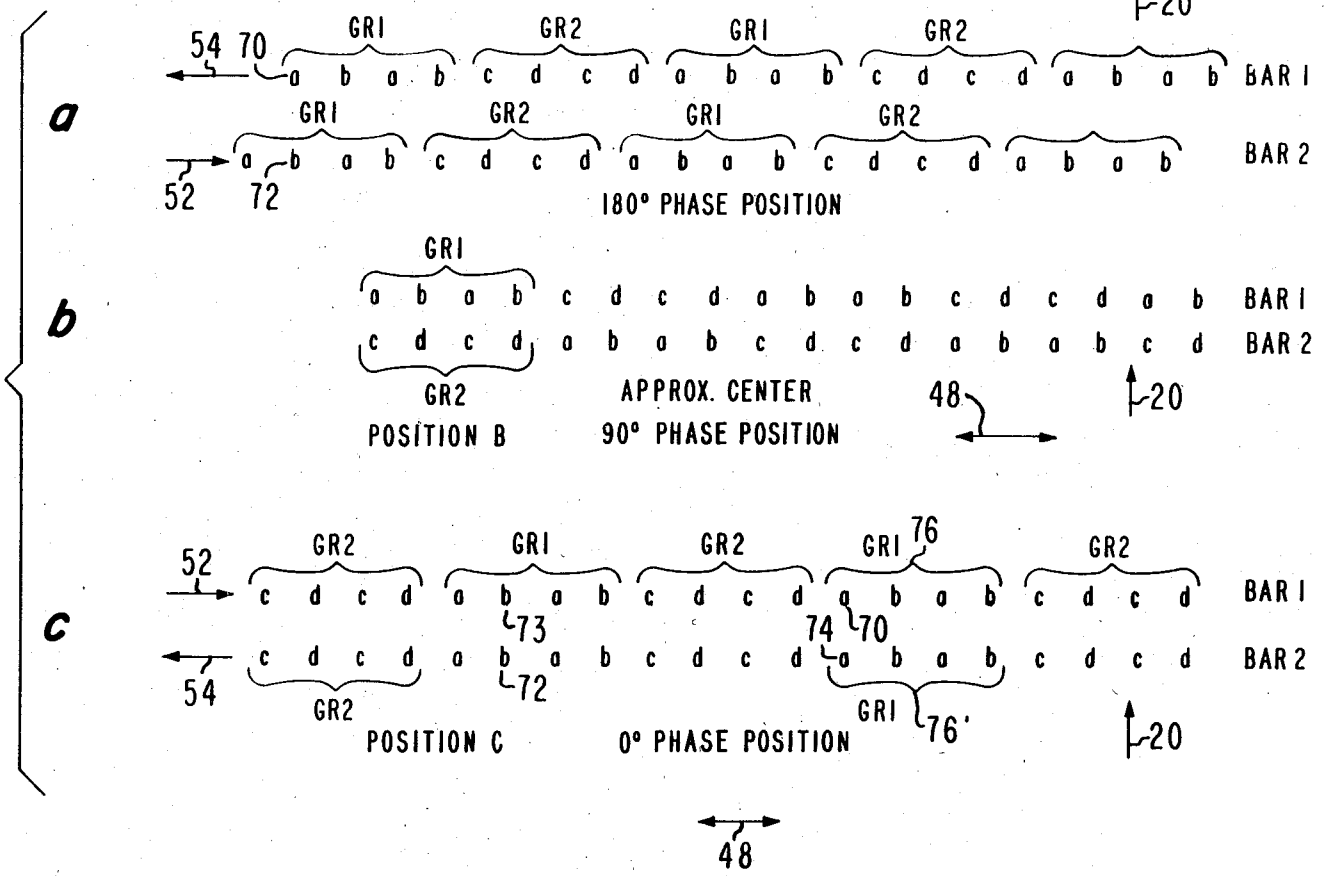
Figure 5:
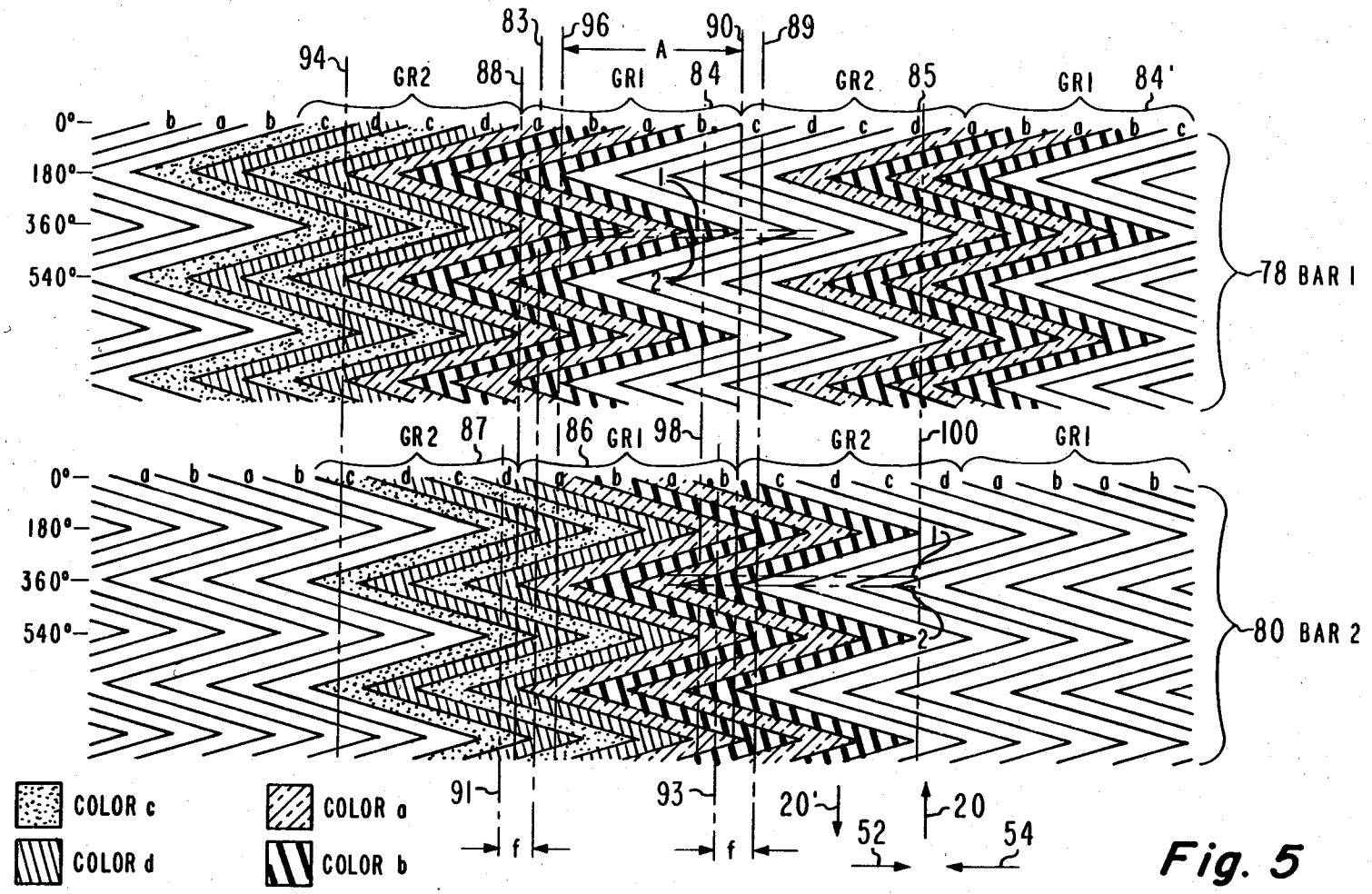
Figure 6:
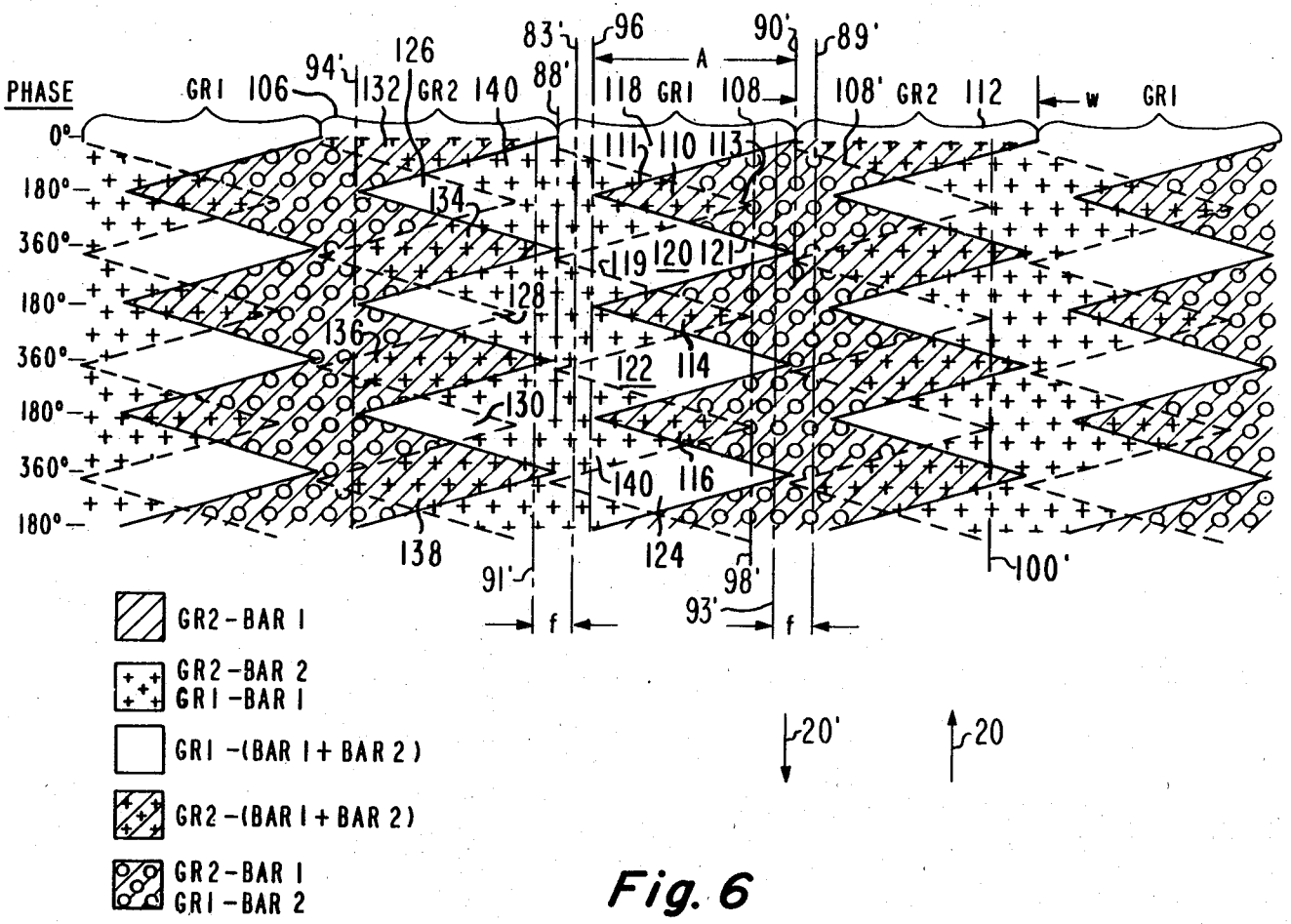
Figure 7:
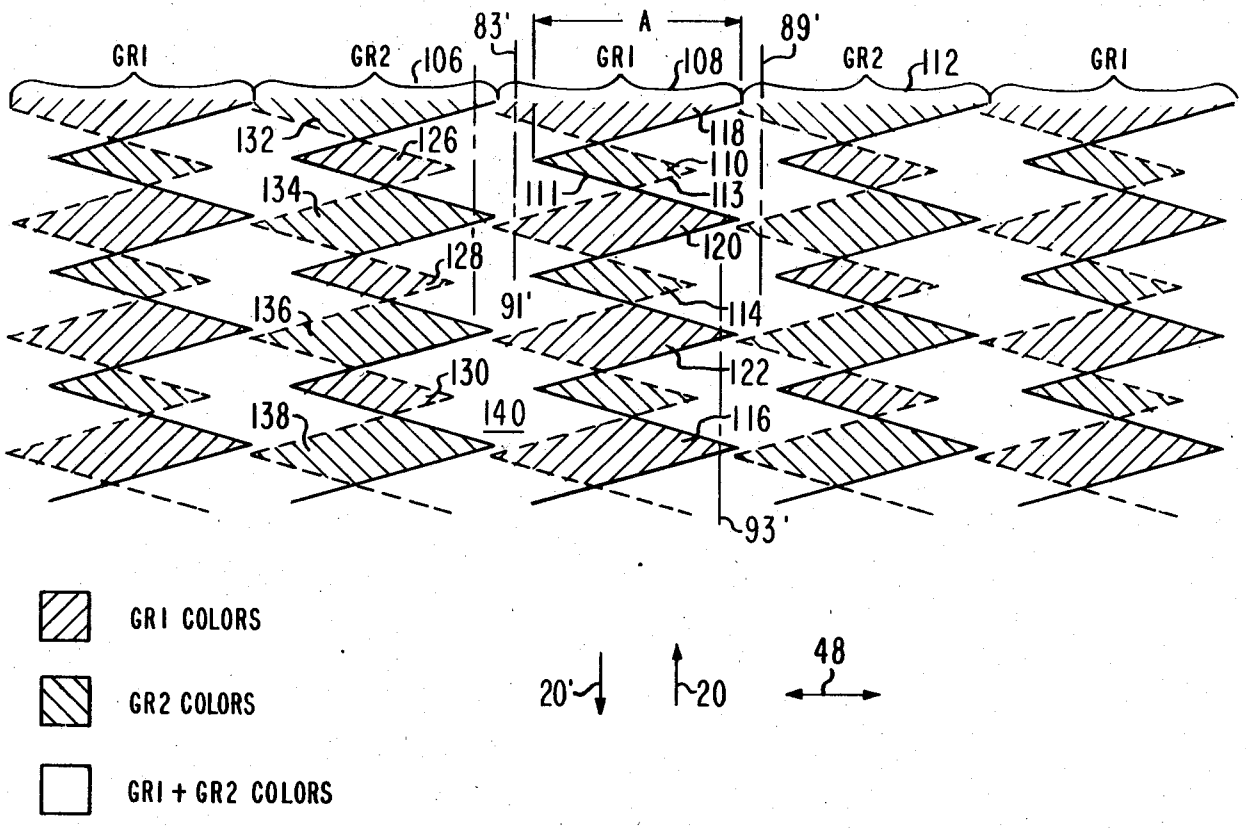

FIG. 3*a* is a side elevation view of a portion of the dyestuff dispensing apparatus of FIG. 1 in more detail;

FIGS. 4*a*, 4*b*, and 4*c* are color scales showing the respective different relative positions of the dyestuff applying nozzles at different successive times in the process in accordance with one embodiment of the present invention;

FIG. 5 illustrates idealized patterns of dyestuff dispensed by the nozzles in plan in which the upper portion of the FIGURE illustrates the dyestuff pattern dispensed by one bar of nozzles and the lower portion of the FIGURE illustrates the dyestuff pattern dispensed by the other bar, the upper portion pattern normally being superimposed over the lower portion pattern;

FIG. 6 is a plan view of the idealized superimposed patterns produced by the patterns of FIG. 5; and FIG. 7 is an alternative plan view of the patterns of FIG. 6.

The apparatus of FIG. 1 is generally employed for foam dyeing tufted carpeting. Pad machine 14 includes a wash box 14' and a pad box 14''. The wash box 14' includes a reservoir (not shown) of clear water at 130° F. and a vacuum water extractor (not shown) through which carpet web 12 passes. The water is extracted to about 60–70 percent liquid pickup. Pad box 14'' includes a reservoir (not shown) containing a prewet solution, colored or colorless, through which the web passes. The carpet web 12 is then conveyed through squeeze rollers (not shown) in box 14'' which remove sufficient prewet solution from the carpet tufts to provide the desired moisture content in the carpet which may be about 80 percent pickup. The prewet solution may be at room temperature but is preferably preheated to 130° F. The prewet solution contains a wetting agent, a softener, a pH control, and a thickening agent and may have a pH of about 6.

The web 12 is then fed from the pad machine 14 over guide rollers 16, 17, 18, and 19 in direction 20. In the vicinity of the guide roller 17 and over the web 12 is a viscous liquid applicator 22 which is described in detail in my application Ser. No. 661,396 mentioned above. In the present process the applicator 22 applies a continuous sheet of colorless viscous gum to the upwardly facing tufted face of the carpet across the entire width of the carpet web as it passes beneath the applicator 22. This gum is a water based vegetable gum solution which is chemically inert with respect to later applied dyes. Chemically inert implies that there is no chemical reaction between the gum and the dyestuff.

The sheet of gum applied by applicator 22 may have a uniform thickness of about ¼ inch when applied across the entire face of the carpet. The viscous gum may be made from any suitable vegetable base as described in the aforementioned application Ser. No. 661,396. The gum base is mixed with a defoamer, a preservative, and acetic acid to provide a slightly acidic solution having a pH preferably in the range of 5.5–6.0. The layer of gum applied by the applicator 22 may have a viscosity of about 1,800 CPS but may be in any range of viscosity as desired, or omitted entirely.

The carpet web is oriented horizontally at this point and is pulled horizontally over the guide rollers by drive rollers (not shown) through foam dye applicator 24. The carpet web 12 may be conveyed in direction 20 at a rate of 60 feet per minute, the web 12 being about 12 feet wide in a direction normal to the drawing figure, FIG. 1. Applicator 24 may be the Kusters foam nozzle dispensing machine discussed above. During the process the carpet web 12 is continuously moving in the direction 20, FIG. 1, while the foamed dyestuff is dispensed onto the gum coated tufted surface. Applicator 24 includes tanks 26, 27, 28, and 29, each respectively containing a separate different low viscosity liquid dye, e.g., 0 CPS.

The dyes are selected to be compatible with the particular synthetic, natural, or mixture of fibers in the particular tufts being dyed. The dyes, known as water soluble "acid dyes," each include a wetting agent, a defoaming agent, and formic acid and have a pH of about 3. Different dye colors in the process have the same ratio of wetting agent, defoaming agents, and formic acid and differ from each other only in the coloring pigments that are applied. In general, the dyes may be formulated by mixing a number of different primary color dye pigments to form the desired color shade.

Tank 26 contains a dye color a, tank 27 contains a dye color b, tank 28 contains a dye color c, and tank 29 contains a dye color d. These tanks may be placed remote from the location of web 12. The dyes from the tanks 26–29 are selectively fed through respective conduits 34, 36, 38, and 40 to foaming and valve apparatus 30.

Apparatus 30, includes aerating devices (not shown) for mixing the dye liquids from the tanks 26–29 with pressurized air at a settable pressure value to foam the liquid dyes in a known way. Each dye from conduits 34–40 is foamed separately in apparatus 30 and supplied to a separate corresponding conduit 34', 36', 38', and 40', FIG. 3. Apparatus 30 also includes a dyestuff distributor 41, FIG. 3, for supplying the foamed dyestuff from conduits 34'–40' through valves V to the selected ones of foamed dyestuff dispensing nozzles 44 and 50 on respective bars 1 and 2. A separate valve V is connected to each nozzle supply hose 44', 50'. These supply hoses are shown schematically as originating from single lines L from distributor 41, but it is to be understood that lines L represent separate hoses each carrying a given color to a corresponding nozzle.

The valves V are opened or closed by a computer programmed controller 32, FIG. 1, in accordance with a given sequence or order. In the present case, all valves V are opened simultaneously when the dyeing process is started and are afterward simultaneously closed when the dyeing process is completed. Each nozzle dispenses a continuous stream of a given foamed dyestuff. While the term "streams" is employed herein to describe one form of the dyestuff that is dispensed by the nozzles 44, 50 of FIG. 3, it is to be understood that this term is intended to be generic to drops and other forms of application.

The air pressure supplied the liquid dyes in the aerating devices can be varied manually (by controls not shown) to form a given foam blow ratio. By "blow ratio" is meant the weight of a given volume of water as compared to the weight of the same volume of dye. By changing the pressure of the air mixed with a given volume of liquid dye flowing in a conduit 34–40, the blow ratio may be changed. It is preferred that the blow ratio lie within a range of 7:1 to 8:1. The ratio can be somewhat more or less than this range. However, too high a ratio, for example 10:1, produces a spotty effect due to the relatively large bubbles and too low a ratio, for example 6:1, produces insufficient spottiness for one desired effect by producing too small a bubble. By "spottiness" is meant concentrated areas of color that give a visual appearance of high contrast as compared to a uniform solid color with no change in contrast. What is desired in one process is a smooth heather effect in which the colors appear uniform.

In FIGS. 2 and 3, bar 1 comprises a linear array of foam dyestuff dispensing nozzles 44 secured to an elongated metal bar 46 which is reciprocated, i.e., moved back and forth, in directions 48 by a bar operator 42, FIG. 1. The stroke length or reciprocating distance A of each bar is the maximum distance the bars move back and forth across the web's width. The nozzles 44 are uniformly spaced a center-to-center distance x along the entire length of the bar. In practice, distance x is about two inches (five centimeters) in one kind of machine. Bar 2 is constructed similarly as bar 1 and is positioned so that its nozzles 50, also spaced center-to-center distance x, are aligned in a second linear array parallel to and spaced from the array of nozzles 44 a distance y, which may be about one inch.

Bar 2 moves back and forth in direction 48 the same distance A as bar 1 but in opposite directions, i.e., 180° out of phase with bar 1.

Bar operator 42, FIGS. 1 and 3*a*, reciprocates the bars 1 and 2 perpendicular to the plane of the drawing sheet and the web's direction of movement 20 with links represented by lines 43 and 49. Operator 42 includes a cam (not shown) coupled to each of the bars 1 and 2 for setting the phase relationship of the reciprocating motions of the two bars. For example, the bars 1 and 2 as supplied by the manufacturer may be reciprocated in and out of the drawing of FIG. 1, in unison or in any relative out-of-phase relationship by the setting of that cam. The bar operator 42 may also selectively maintain the nozzle bars 1 and 2 stationary during the dispensing of the foamed dyestuff (a cycle that is not used in the present process). In the present process, however, the bars 1 and 2 move in only one selected phase relationship, 180° out of phase, i.e. back and forth in opposite directions across the web's width.

The bar operator 42 mechanisms for moving the bars is independent of the operation of the dyestuff dispensing valves V of the apparatus 30. That is, the two systems, apparatus 30 and operator 42, can be operated in any desired combination offering a wide degree of flexibility in use of applicator 24.

In FIG. 3*a*, the dyestuff streams 45 and 51 from respective nozzles 44 and 50 are applied directly over an applicator roller 53. Roller 53 is a stainless steel smooth surfaced cylinder extending completely across the width of web 12. The roller 53 is rotated in direction 55 so that its peripheral speed matches that of the web 12 in direction 20. The dyestuff streams 45 and 51 are applied to the roller 53 simultaneously so that the streams 45 are superimposed over the streams 51 after impinging on roller 53. A doctor blade 57 picks the foamed dyestuff off the surface of roller 53. The foamed dyestuff flows by gravity on the doctor blade 57 as a sheet 59 and onto the tufted gum coated surface 61 of the web 12. The streams after flowing onto the doctor blade 57 tend to spread somewhat to provide a continuous sheet 59 of dyestuff to ensure the tufted surface 61 is fully covered by the dyestuffs.

Because the nozzles 44 and 50 on the bars 1 and 2 are always open during the dyeing operation of the present process, the foamed dyestuffs dispensed by the nozzles are supplied to the roller 53, and thus the tufted surface of the carpet web 12, FIG. 1, as a plurality of narrow continuous adjacent streams, colors a, b, c, and d, forming patterns as shown in FIG. 5. In FIG. 3, when bar 1 is moving in direction 52, bar 2 is moving in the opposite linear direction 54. Conversely, at the end of the stroke direction 52, bar 1 is moved in the reverse direction 54 and simultaneously therewith, bar 2 is moved in the reverse direction 52.

In FIG. 3, the foamed dyestuff is supplied from the distributor 41 to nozzles 44 and 50 in multiple groups of four dyestuffs each, each nozzle receiving a separate dyestuff. In this embodiment, each group such as group GR1 includes dyestuff of two colors, colors a and b which alternate in the linear array. Thus, group GR1 comprises four nozzles $50_1$, $50_2$, $50_3$, and $50_4$. Two nozzles $50_1$ and $50_3$ receive color a and two nozzles $50_2$ and $50_4$ receive color b. The next group in the nozzle array on bar 2 includes group GR2 comprising nozzles $50_5$, $50_6$, $50_7$, and $50_8$ whose colors are in the respective order c, d, c, d, as shown. The next group of colors on bar 2 is group GR1 alternating with group GR2 and so on for the length of the bar which extends the full width of web 12, FIG. 1. The same colors and groups of colors in the same sequence on bar 2 are supplied to the nozzles 44 of bar 1 except that the left-most end groups of bar 1 are group GR2 colors and on bar 2, are group GR1 colors. One group, e.g., GR1, colors may be designated as color 1 which is intended herein to be generic to one or more colors that make up a given color group, e.g., the two different colors, a and b, of group GR1. The group GR2 colors may be designated color 2 which also is intended herein to be generic to one or more colors that make up a given color group, e.g., the two different colors c and d, of group GR2.

The group GR1 colors may have an overall effect of one kind of a color, for example, they may be red and yellow, and the group GR2 may be colors complimentary to the colors of group GR1 and may be blue and green. The blue and green colors of the group GR2 when applied to a given region visually appear as one color and the group GR1 colors when applied to another region appear visually as a second color. This grouping of the colors is by way of example, as many other combinations and permutations of coloring effects may also be achieved by the process to be described.

It would appear by observation of FIG. 3 that the interspersing of the nozzles of the superimposed different colored dyestuffs on the gum coated carpet web would tend to achieve general mixing of the different colors of the dyestuffs. While some color mixing does occur, however, as will be described below, the process and apparatus that is operated in accordance with the present invention produces a predominant patterned effect with colors of one group such as group GR1 appearing separately and distinct in different regions of the carpet from the colors of the other group GR2. These patterns periodically recur in spaced regions over the carpet surface. Dyestuff from groups GR1 and GR2 are also applied in other regions resulting in the mixing of all colors of dyestuff from the different nozzles between these so-called pattern regions. This mixing effect tends to provide a fully colored tufted web of carpet. However, the predominate overall visual appearance is one of a repeating pattern effect rather than a random multicolored blended effect.

In FIGS. 5, 6, and 7, the patterns are illustrated as geometric, straight lines. These patterns represent the regions of the foamed dyestuff dispensed by the reciprocating nozzles 44 and 50 on roller 53 immediately after the dyestuff leaves the nozzles. It is to be understood that after the viscous foamed dyestuff reaches the gum coated surface of the moving tufted web 12, the web motion and the flowing fluid action of the foamed dyestuff on roller 53, doctor blade 57 and the web 12 tend to cause movement of the dyestuffs to adjacent areas. As the web moves in direction 20 from the vicinity of the apparatus 24 over the rollers 18 and 19 to the steamer 60, the foamed dyestuffs tend to mingle somewhat and appear not at all to have the strict geometric shapes of FIGS. 5–7, but a modulated wavy appearance which appears visually non-linear and more randomly occurring. Regardless of this modulation and mixing effect, the carpet visually exhibits a predominant pattern effect after the dyes are fixed in the steamer 60. This pattern effect appears unexpectedly in view of the multitude of nozzles and different superimposed colors that are applied.

The steamer 60, FIG. 1, elevates the temperature of the web 12 applying hot moist air to that web in a known way to cause the foam and gum layer to disintegrate and to fix the dyestuff. The steamer 60 includes a number of sets of rollers for transporting the carpet therethrough. The carpet exits the steamer 60 at 62 and is passed into a washing apparatus (not shown) and then to a dryer (not shown).

To achieve the desired pattern effect with the many nozzles of the applicator 24, groups GR1 and GR2 of nozzles are located in alternate positions on bars 1 and 2, FIGS. 4*a*, *b*, and *c*, where the letters "a, b, c, d" refer to nozzles which dispense that particular dye color. Also, the figures ilustrate only midportions of the bars 1 and 2. In FIG. 4*a*, position A, bar 1 is at its extreme left end stroke position, direction 54, and bar 2 is at its extreme right end position, direction 52. In FIG. 4*b*, position B, bars 1 and 2 are approximately at midstroke during their back and forth motions across the width of the carpet web in directions 48. In FIG. 4*c*, position C, the bars are shown in the extreme end stroke positions diametrically opposite that of position A, FIG. 4*a*. in FIG. 4*c*, bar 1 is at its extreme right position, direction 52, and bar 2 is at its extreme left position, direction 54.

In FIG. 4*a* the group GR1 colors from bars 1 and 2 are substantially aligned within the spacing of one pair of nozzles, distance x, FIG. 2, in direction 20 and, FIG. 4*c*, are more closely aligned. In position B, the group GR1 colors are aligned in direction 20 with the group GR2 colors. To achieve the above relative alignments, the stroke length of the bars in directions 48 are made the same and tend to be slightly less than the transverse width of the group GR1 or group GR2 colors in directions 48. That is, the bar 1 is moved in direction 54 or direction 52 a total distance equivalent to slightly less than the spacing of a given group of colors, for example 3.5x, where x is the nozzle spacing, FIG. 2. By way of further example, assume the spacing between the nozzles 44, FIG. 3, is two inches (five centimeters) center-to-center and is the same for nozzles 50, bar 2. Bars 1 and 2 each reciprocate a total stroke, directions 48, of about seven inches (18 centimeters). The total relative stroke distance between the two bars 1 and 2 is about 14 inches (36 centimeters). Thus, the total relative stroke displacement of the two bars is equivalent to the spacing of about seven nozzles or 7x (FIG. 2) while the total number of nozzles in the two groups is 8.

In FIG. 4*a*, color a, 70, is aligned in direction 20 with color b, 72. Color a, 70, bar 1, is at the extreme left-most position, direction 54, and color b, 72, bar 2, is at the extreme right-most position, direction 52. At the other extreme position, position C, FIG. 4*c*, the color a, 70, is aligned with a color a, 74, of bar 2, direction 20. Bar 2, color b, 72, is now aligned with color b, 73, bar 1. The bar 1 group GR1 colors, for example, color group 76 are directly aligned with the same group of colors, group 76', bar 2, in direction 20. Thus, substantial alignment of the same color groups of the two bars occurs at both extremes of the bar strokes.

It is known during reciprocating motions that the velocities of the reciprocating bars vary from a maximum at mid-position to zero at the end position. Because of the zero velocity at the end stroke positions, the bars tend to linger somewhat relative to their position midstroke at which they are at maximum velocity. As a result, the dyestuff dispensed by the nozzles at the end stroke positions tends to be dispensed over relatively longer time intervals and, thus over larger areas of the continuously moving carpet web surface than the dyestuffs being dispensed at midstroke. This lingering effect coupled with the alignment of the color groups, with other factors, tends to create more smoothly curved patterns than shown.

That is, it is to be understood that the idealized shapes of the patterns generated in FIGS. 5, 6, and 7 are shown angularly for purposes of illustration only. The sharp angular shifts in the path direction of FIGS. 5, 6, and 7, at the extreme end positions of the strokes, in practice, are smoother curves and occur more gradually than shown due to the continuous motion of the web 12 in direction 20, FIG. 1. The resultant paths of the dispensed dyestuff produced by the nozzles 44, 50, FIG. 3, are zigzagged, FIG. 5.

In FIG. 5, the pattern 78 in the upper portion of the drawing is produced by the dyestuff dispensed by the bar 1 nozzles. The relative positions of bars 1 and 2 are shown by the broken horizontal lines. The pattern 80 at the bottom portion of the drawing figure is produced by the bar 2 nozzles. In practice, these two patterns are applied simultaneously and are superimposed as shown in FIG. 3*a*. The bar 1 pattern of colors 78 and the bar 2 pattern of colors 80 both have the same colors a, b, c, d, as shown. The separation of the patterns 78 and 80, FIG. 5, is for purposes of illustration. The paths of the group GR1 and group GR2 dyestuffs dispensed by bar 2 zigzag 180° out of phase with the zigzag paths of the superimposed bar 1 dyestuffs. The paths are actually produced generally in the direction 20′ opposite the direction of the movement of the carpet web, direction 20. The bar 1 dyestuffs are applied over the bar 2 dyestuffs since the bar 2 dyestuffs reach roller 53 surface first.

The bar 1 group GR1 set of colors 84 zigzag in direction 20′ about axis 83 distance A. The bar 1 group GR2 set of colors 85 zigzag in direction 20′ about axis 89 distance A. The bar 2 group GR1 set of colors 86 zigzag distance A in direction 20′ about an axis 93 parallel to and spaced from axis 89. The bar 2 group GR2 set of colors 87 zigzag in direction 20′ distance A about an axis 91 spaced from and parallel to axis 83. Axis 89 is spaced from axis 83 a distance 4x or the spacing of a color group comprising four nozzles. Axis 83 and 91 are spaced apart a distance f which is the same spacing as axis 89 from axis 93. As can be observed in FIG. 5, the group GR1 colors 84 appear substantially superimposed over the group GR2 colors 87, and the colors 85 appear to be substantially superimposed over the colors 86. Two different color groups GR1 and GR2, bars 1 and 2 zigzag relative to the respective parallel axis 83 and 91 180° out of phase. Next adjacent those two color groups color groups GR2, GR1, bars 1 and 2 zigzag about the respective parallel axes 89 and 93 also 180° out of phase. These relationships produce the pattern effect described below. While the bar 1 and bar 2 groups GR1 and GR2 colors zigzag about spaced parallel axes, e.g., 83 and 91, they could also zigzag about the same axis to give a different pattern effect than is described below. Also, the distance of the different paths may differ in different implementations.

Examination of the FIG. 5 patterns reveals several factors of significance. Because both bars are moved the same stroke distance, transversely directions 20, 20′, distances A of the different zigzag patterns are identical. The dyestuff colors a and b, of each group GR1, lie in adjacent contiguous paths as do the colors c and d, group GR2. The dispensed adjacent dyestuff groups, colors a, b and c, d in respective groups GR1 and GR2 are contiguous and, for a given bar, lie in parallel zigzag paths. If the group GR1 set of colors 84, FIG. 5, pattern 78, is traced relative to the group GR1 set of colors 86, bar 2, pattern 80, the uppermost edge of the patterns 78 and 80 in the figure corresponds to a 0° phase position where the term "phase position" refers to the relative transverse position of the bars during their back and forth displacement. This 0° phase position relates to one extreme transverse position of the bars, e.g., when the bars are as shown in FIG. 4*c*. The other extreme transverse position is the 180° phase position, FIG. 4*a*.

Broken lines 88 and 90 parallel to direction 20 extend through the patterns 78 and 80. At the 0° phase position (and in 360° intervals therefrom, the group GR1, 84 and 86, colors of both bars are bounded in the transverse direction by the broken lines 88 and 90 (the two groups being aligned in direction 20). This relative aligned position repeats every 360° or at the beginning and end periods of one complete reciprocating cycle of bars 1 and 2.

The group GR1 set of colors 84, bar 1, is shifted to the left at the 180° phase position (FIG. 4*a*) to an area that is bounded by broken lines 94 and 96 which extend in direction 20. The path of colors 84 then traces to the boundary between broken lines 88 and 90 at the 360° phase position and repeats, as shown. Because the stroke of bar 1 has a maximum length of slightly less than the transverse width of each group of colors, there is some overlap of the areas bounded by broken lines 88 and 90 with the areas bounded by the broken lines 94 and 96. This is by way of example as the strokes could be somewhat greater or smaller in length.

Because the bar 2 nozzles are closely spaced to the bar 1 nozzles, about one inch in one embodiment, the pattern 78 of bar 1, FIG. 5, is laid down substantially 180° out of phase with the pattern 80 of bar 2. It is apparent that there is some spacing between the two arrays of nozzles of bars 1 and 2, as shown in FIGS. 3*a* and 5, but, in practice, they appear to be originating at the same 0° phase position. Therefore, it is to be understood that the 0° phase position for the pattern 80 of bar 2 can be spaced slightly in direction 20′, FIG. 5, from the 0° phase position of the pattern 78 produced by bar 1.

In patterns 78 and 80, the broken lines 88 and 90 which bound the group GR1 colors 84 of bar 1 at 0°, 360°, and so forth also bound the aligned group GR1 colors 86 dispensed by the nozzles of bar 2 at these phase positions. Then, when the group GR1 colors 84 of pattern 78, move left to the region between broken lines 94 and 96, the group GR1 colors 86 move right to the region between the broken lines 98 and 100. At this point both bars are in the 180° phase position and are at their extreme ends of a stroke. The bars are again moved in opposite directions, bar 1 moving to the right in direction 52 and bar 2 moving to the left in direction 54 until the bars return to the other end stroke position at the 360° phase point.

By following the paths of the bar 1 pattern 78 and superimposing the paths of the bar 2 pattern 80, certain portions of the same groups of colors from the two patterns 78, 80 tend to overlap. For example, in the 0° phase positions and in 360° multiples thereof, the group GR1 colors of both patterns 78, 80, e.g., between broken lines 88, 90, are deposited in one region. Because the bars 1 and 2 change directions, a relatively larger area receives the group GR1 colors from bars 1 and 2 in that region. Similarly, at the 180° position and at 360° multiples thereof, the group GR2 colors are predominate between lines 88, 90 in one region. These predominately colored regions repeat throughout the carpet surface. All of this will become clearer in the discussion below in reference to FIGS. 6 and 7. In any event, in this embodiment the carpet web is fully colored by the superimposed dyestuffs from bars 1 and 2.

In FIGS. 6 and 7, the pattern effect produced by the above-described relationships of the dye dispensing nozzles is more apparent. In FIG. 6, the line shaded areas represent the group GR2 colors deposited by the nozzles on bar 1. While this area is shaded one shade to represent a group of colors, it is to be understood that it represents multicolors which, in this case, may be the two exemplary colors a and b and also may be more or fewer colors. The group GR1 colors of bar 1 are unshaded. The two color groups of bar 1 are outlined in solid lines to show their respective paths. The path width of each group of colors is w and in this case is the same. The group GR1 colors (a, b) alternate with the group GR2 colors (c, d). All of the paths of the two groups of bar 1 zigzag on the web surface in parallel in the general direction 20'. The primed reference numerals in FIG. 6 correspond to similar elements in FIG. 5.

The bar 2 color groups are outlined in dashed lines to show their paths superimposed with the paths of the bar 1 color groups. The group GR2 colors of bar 2 are shaded with +'s. The bar 2 group GR1 colors are unshaded. The legend of FIG. 6 illustrates the groups of other regions where colors from the different groups mix (shaded with lines and o's). The path width w is the same for the bar 2 color groups which zigzag 180° out of phase with the bar 1 colors. Groups GR1 and GR2 alternate on bar 2 as shown and are similarly formed on the web surface in the general zigzag direction 20'. The group GR2 colors, bar 1, overlap in certain defined regions with the group GR2 colors of bar 2. For example, diamond-shaped shaded region 110 comprises only group GR2 colors. The left-most boundary 111 (solid line) of region 110 is formed by the interface of the bar 1 group GR2 colors 112 with the bar 1 group GR1 colors 108. The right-most region boundary 113 (dashed line) is formed by the interface of the bar 2 group GR2 colors 106 with the bar 2 group GR1 colors 108. Similar diamond-shaped shaded regions 114, 116 and so forth repeat in spaced intervals in direction 20' and are produced by the overlapping group 2 colors 106 and 112 of bars 2 and bars 1, respectively.

Alternating with the regions 110–116 in direction 20' are unshaded diamond-shaped regions 118, 120, 122, and 124 and so forth. These diamond-shaped regions comprise only group GR1 colors from bars 1 and bars 2, e.g., colors 108 on bar 1 and 108' on bar 2. For example, region 120 is bounded on the left by dashed line 119 and on the right by solid line 121. These diamond-shaped regions 110–124 include colors from one particular color group (either GR1 or GR2) as shown. While the dye colors may be different in a given group, the resulting pattern effect provides enhanced visibly discernible regions as compared to the random pattern effect when the foam applicator is used in its normal intended way.

Transversely aligned with regions 110, 114, and 116 at the same phase positions are respective diamond-shaped unshaded regions 126, 128, and 130 and so on. These regions comprise solely the group GR1 colors and are formed in a similar manner as the regions 118–124. Transversely aligned in the same phase position with the regions 118–124 are group GR2 colors diamond-shaped pattern shaded regions 132, 134, 136, and 138, and so on. The remaining regions of the carpet surface between the pattern areas produced by the diamond-shaped patterns 110–138 lie in background regions 140 and comprise overlapping colors from the color sets of groups GR1 and GR2. Regions 140 tend to have a more randomly blended appearance and do not visually appear to have the more rigid pattern effect as the diamond-shaped regions because of the mixture of the different colors that are employed in the process. Because the dyestuff from the nozzles are all dispensed continuously and in zigzag paths, some patterning may appear in region 140 but this pattern is substantially more subtle and significantly less pronounced than the diamond patterns described above.

As can be seen by observation of FIG. 6, a relatively large portion of the surface has patterned regions similar to regions 110–138 as compared to the unpatterned regions 140. The overall effect is that of a patterned design rather than a random blending effect as achieved in the prior art processes.

In FIG. 7, bar 1 color group paths are shown outlined with solid lines and bar 2 color groups are outlined with dashed lines. The diamond patterns of the group GR1 colors are shown in one shading and the group GR2 colors in a second shading. The mixture of the group GR1 and group GR2 colors is unshaded (regions 140 of FIG. 6). This mixture of colors are those colors deposited by both bar 1 and bar 2 nozzles. The GR1 colors alternate in diamond-shaped patterns with the GR2 colors in similar shaped patterns, in direction 20 parallel to the length of the web of carpet and in directions 48 transverse to the length dimension of the carpet. This pattern effect, depending on the colors, the contrast between the different colors used and other factors such as the relative dimensions of the patterns, results in very pleasing and striking appearances.

In one embodiment, the group GR1 colors can comprise one set of colors of a given color having one degree of saturation. The group GR2 colors can comprise a second set of colors of the same color as the group GR1 but having a second different degree of saturation. (By saturation is meant the degree of whiteness of one color with respect to another.)

The size of the diamond-shaped pattern areas can be determined by the relative oscillation speeds of the bar 1 and bar 2 sets of nozzles as compared to the web speed in direction 20. By speeding up the reciprocating rate of the bars relative to the web speed, the diamond-shaped pattern areas become narrower in the direction 20. By increasing the carpet web 12 speed relative to the oscillating rate of the bars, the diamond-shaped patterns can be stretched and elongated in direction 20. Further, the amount of overlap of the same colors from one group is determined by the number of nozzles in that group and also by the stroke length of the bars. In one example the web speed was 60 feet per minute, the stroke lengths of the bars was about seven inches, the stroke rate was 95 strokes per minute and the blow ratio was 7:1.

By increasing the stroke length of each bar from seven inches to about eight inches (18 cm to 20 cm) an undesirable line pattern was produced, so that the relative factors need be carefully determined to provide the desired spaced pattern. It is apparent, however, that other kinds of pattern effects may be achieved by varying the number of different variables in the process.

The distance A of the paths may generally be slightly less than the width of one set of dyes in a given group. Also, substantially all of the color groups have the same number of nozzles notwithstanding that the end color groups of each bar may have a partial color group. However, the distance A may be different from that shown depending upon the pattern effect desired.

What is significant is that a number of different colored dyes, four as shown in FIG. 5, are dispensed simultaneously one over the other in continuous streams and yet the overall effect appears to be that of a somewhat printed pattern look rather than a blending appearance as would be ordinarily expected with such mixtures of dyestuffs.

It is apparent that by using a computer program and opening and closing the valves to the nozzles so that the dyestuffs of the different groups are only dispensed in the regions 110–138, FIG. 7, a more predominant pattern effect can be achieved by avoiding the use of similar colors in the adjacent regions 140. The pad machine 14, in this case, might be employed to color the entire web including the regions 140. Also, the adjacent regions 140 may be dyed with some other color later in the process by other dyeing machines. The important factor to consider is that a pattern effect can be achieved with a large plurality of closely spaced foamed dyestuff dispensing nozzles by dispensing the dyestuff from selected ones of the nozzles in two sets of a given sequence of alternating colors as the nozzles in each set are moved back and forth in opposite directions across the textile web width as the web is moved forward beneath the nozzles. As a result, overlapping regions of the same colors give the pattern effect while at the same time overlapping regions of different colors give a background color thereby coloring the entire carpet surface.

What is claimed is:

1. A continuous textile dyeing process comprising:

moving a length of a textile web in a given forward direction;

supplying foamed dyestuffs in a sequence of alternate first and second colors to a first set of spaced nozzles and to a second set of spaced nozzles spaced from the first set;

moving the first and second sets of nozzles back and forth across the width of the web in opposite directions; and applying the sequence of dyestuffs from the sets of nozzles to a surface of the forward moving textile with the dyestuffs from one set being superimposed over the dyestuffs of the other set;

the spacing of the nozzles and the applied first and second colors and the distance the nozzles move across the web being such that repeating spaced patterns of substantially only the first color and of substantially only the second color are produced on the textile surface having a background region containing the first and second colors, each pattern of a given color being produced by dyestuffs from both sets of nozzles.

2. The process of claim 1 further including the steps of prewetting said textile.

3. The process of claim 1 wherein said step of applying said dyestuffs includes applying a plurality of streams or dyestuff of each of the first and second colors, each color forming a corresponding group, said groups extending across said forward direction in a given alternating sequence.

4. The process of claim 3 wherein each of said groups includes at least two subgroups, each subgroup containing a set of at least two different colors, the two subgroups together having at least four different colors, the subgroups being applied to the nozzles in a given alternating sequence to produce a first repeating pattern containing the at least two different colors of one subgroup and a second repeating pattern including the at least two different colors of the other subgroup and a background of a mixture of the at least four colors.

5. The process of claim 1 wherein the textile is a tufted carpet and the dyestuffs are applied to upstanding tufts.

6. A continuous textile dyeing process comprising:

moving a length of carpet in a forward direction;

applying a first sequence of alternating first and second colored foamed dyestuffs to the surface of and across the width of the moving length of carpet; and applying a second sequence of the alternating first and second colored dyestuffs to said surface and across the width of the moving length of carpet in opposite directions to the first sequence;

the spacing of the applied dyestuffs to each other and the distance the dyestuffs are moved across the width being related such that a repeating pattern of the first dyestuffs from each said sequence and a repeating pattern of the second dyestuffs from each said sequence spaced from the first pattern is produced having a background containing the first and second colors.

7. The process of claim 6 wherein the first and second sequences each include applying third and fourth colored dyestuffs, the first and second colored dyestuffs being applied in a first group, the third and fourth colored dyestuffs being applied in a second group, the third and fourth dyestuffs alternating in the second group in a sequence, the two groups alternating in the first sequence and in the second sequence.

8. A continuous textile dyeing process comprising:

supplying foamed dyestuffs in a sequence of alternate first and second colors to first and second sets of spaced nozzles, each set aligned in a linear array and spaced from the other array;

moving a length of a textile adjacent to the nozzles in a given forward direction; and moving the first and second sets of nozzles back and forth in opposite directions across the width of the textile as the nozzles apply their received dyestuffs to the adjacent textile;

the spacing of the arrays from each other, the spacing of the nozzles, and the distance the nozzles are moved across the width of the textile being related such that a repeating spaced pattern of the first color from each set of nozzles and of the second color from each set of nozzles is produced on the textile with a background region containing the first and second colors.

9. The process of claim 8 wherein the rate of speed of the nozzles in their back and forth displacement and the relative rate of speed of the forward moving textile are so related so as to produce a pattern of a given relative size.

* * * * *

UNITED STATES PATENT AND TRADEMARK OFFICE
CERTIFICATE OF CORRECTION

PATENT NO. : 4,601,727

DATED : July 22, 1986

INVENTOR(S) : David B. Nichols, Jr.

It is certified that error appears in the above-identified patent and that said Letters Patent is hereby corrected as shown below:

Column 9, line 32, "Axis" should be --Axes--.

Column 9, line 39, "axis" should be --axes--.

Column 13, line 52, "or" should be --of--.

Signed and Sealed this

Seventh Day of October, 1986

[SEAL]

*Attest:*

DONALD J. QUIGG

*Attesting Officer*

*Commissioner of Patents and Trademarks*